US006691372B2

(12) United States Patent
Ruhland

(10) Patent No.: US 6,691,372 B2
(45) Date of Patent: Feb. 17, 2004

(54) LIGHTWEIGHT EXTENDABLE HANDLE FOR DEMOLITION TOOLS

(76) Inventor: Andrew Ruhland, 120 Mockingbird Ln., Spring Lake, NC (US) 28390

( * ) Notice: Subject to any disclaimer, the term of this patent is extended or adjusted under 35 U.S.C. 154(b) by 0 days.

(21) Appl. No.: 10/139,543

(22) Filed: May 7, 2002

(65) Prior Publication Data

US 2003/0208883 A1 Nov. 13, 2003

(51) Int. Cl.[7] ..... B25G 3/00

(52) U.S. Cl. ..... 16/422; 16/429; 16/436; 81/177.1

(58) Field of Search ..... 16/422, 429, 436; 403/109.3, 109.7; 15/144.4, 147.2, 143.1; 81/177.85, 177.1, 177.2, 489, 491

(56) References Cited

U.S. PATENT DOCUMENTS 4,325,157 A * 4/1982 Balint et al. ..... 15/144.4
4,376,397 A * 3/1983 Newby et al. ..... 81/177.2
4,581,958 A * 4/1986 Shull ..... 81/177.2
4,829,857 A * 5/1989 Jones ..... 81/177.1
5,272,788 A * 12/1993 Gilstrap ..... 16/422
5,396,820 A * 3/1995 Baker ..... 81/177.2
5,579,557 A * 12/1996 Boden ..... 16/429
6,421,879 B1 * 7/2002 Gratz et al. ..... 16/422
6,546,596 B2 * 4/2003 Grote et al. ..... 16/429

FOREIGN PATENT DOCUMENTS

JP 2000157753 A * 6/2000

* cited by examiner

*Primary Examiner*—Chuck Y. Mah
(74) *Attorney, Agent, or Firm*—Coats & Bennett, P.L.L.C.

(57) ABSTRACT

An extendable tool handle with a hollow gripping handle (1) comprised of 2024 T3 aluminum with a knurled segment (2), through which an extendable slide shaft (3) comprised of 6AL 4V titanium with a longitudinal slide groove (4) may travel. The slide shaft (3) can be locked in either the extended or collapsed position by means of a lock comprising a spring plate (5), and spring cap (6) of 2024 T3 aluminum, and a 19/64 button head screw (8).

8 Claims, 4 Drawing Sheets

LIGHTWEIGHT EXTENDABLE HANDLE FOR DEMOLITION TOOLS

CROSS-REFERENCE TO RELATED APPLICATIONS

Not Applicable

BACKGROUND

1. Field of Invention

This invention relates to the field of hand-tool handles that may be affixed to various types of demolition or wrecking tools.

2. Description of Prior Art

There are a number of manufacturers of demolition or wrecking tools in a class that are generally called "hooligan" devices. These consist of a heavy forged tool head with several sharp tapered protrusions affixed to a long handle of metal or wood. They are commonly employed by fire departments, rescue crews, police "SWAT" teams, or military "special forces" groups. They are generally used to force entry through a secured door, window, or to create an opening to an interior space. The handle affixed to the devices is generally long, thirty inches or more, this is necessary to facilitate two-handed operation in order for the operator to be able to impart sufficient energy to the tool for it to operate effectively. While a number of variations have been employed with respect to the tool head, or working portion of the device, no improvement has been attempted with respect to the handle portion of the device. Therefore all of the devices of this class heretofore known suffer for distinct disadvantages with respect to the handle portion of the device:

(a) The nature of the designed use for these tools necessitates that the handle be of sturdy design and stout materials, or the handle-to-tool interface will fail, or the handle itself will fail. A wooden handle can crack and a metal handle bend or fracture.

(b) The heavy weight of the handle contributes significantly to the overall tool weight, which in turn can lead to operator fatigue. This is especially significant in situations where the tool must be carried long distances before it can even be utilized.

(c) The long handle, besides contributing to overall weight, can also contribute to bulk of the tool and can make it cumbersome to carry or transport.

SUMMARY

In accordance with the present invention a lightweight extendable handle for demolition tools consists of a hollow tube through which an extendable handle can slide and lock in either the collapsed or extended position.

Objects and Advantages

Accordingly, besides to objects and advantages of the lightweight extendable handle for demolition tools described in the above patent, several objects and advantages of the present invention are:

(a) to provide a demolition tool handle that is very strong and will not fracture, bend or fail, even with the most severe use.

(b) to provide a handle for a demolition tool that will be very light in weight and not contribute to operator fatigue, either while being carried or while being used.

(c) to provide a demolition tool handle that will reduce the tool handle length by fifty percent during the transport or carrying portion of tool operation, thus reducing bulk and increasing convenience significantly.

Further objects and advantages are to provide a universal handle that can be affixed to various tool head designs, so that the applications for the lightweight extendable tool handle are very broad and not limited to a single type or class of tool head. Still further objects and advantages will become evident from a consideration of the ensuing description and drawings.

DRAWING FIGURES

In the drawings, the figures have the same numeric references.

Reference Numerals In Drawings

| | |
|---|---|
| 1 gripping handle | 2 knurled segment |
| 3 slide shaft | 4 slide groove |
| 5 spring plate | 6 spring cap |
| 7 ¼ by 20 button head screw | 8 19/64 button head screw |
| 9 pull wire | 10 mounting hole |

DESCRIPTION—FIGS, 1, 1A, 2, 2A 3, and 4—PREFERRED EMBODIMENT

Figure 1A:
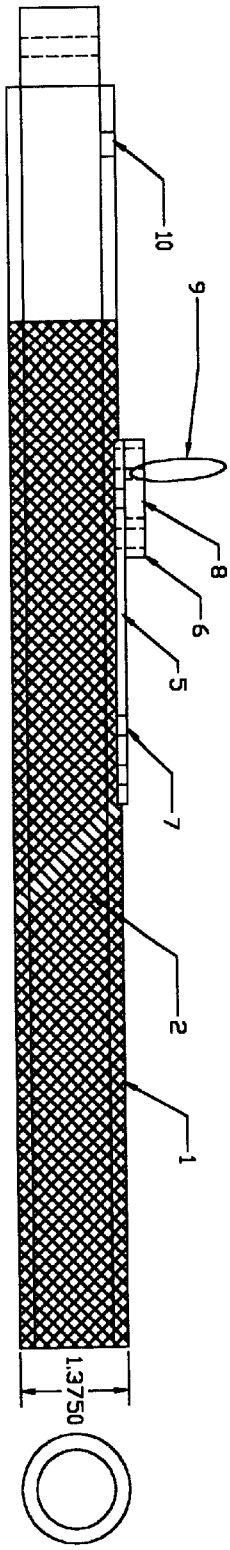
FIG. 1A shows the extendable handle, gripping handle, side view.
Figure 1:
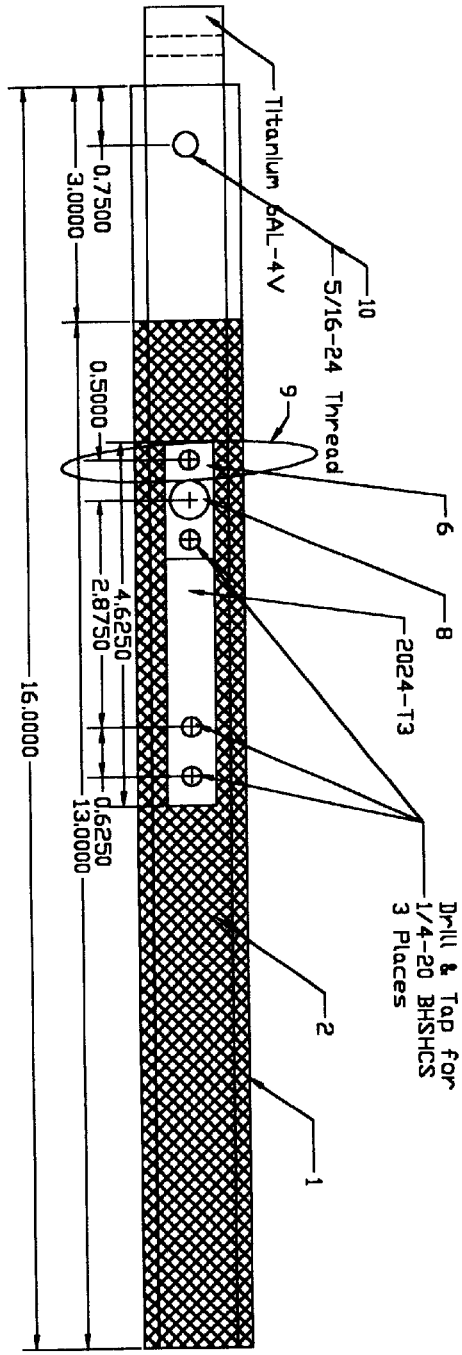
FIG. 1 shows the extendable handle, gripping handle, top view.
Figure 2:
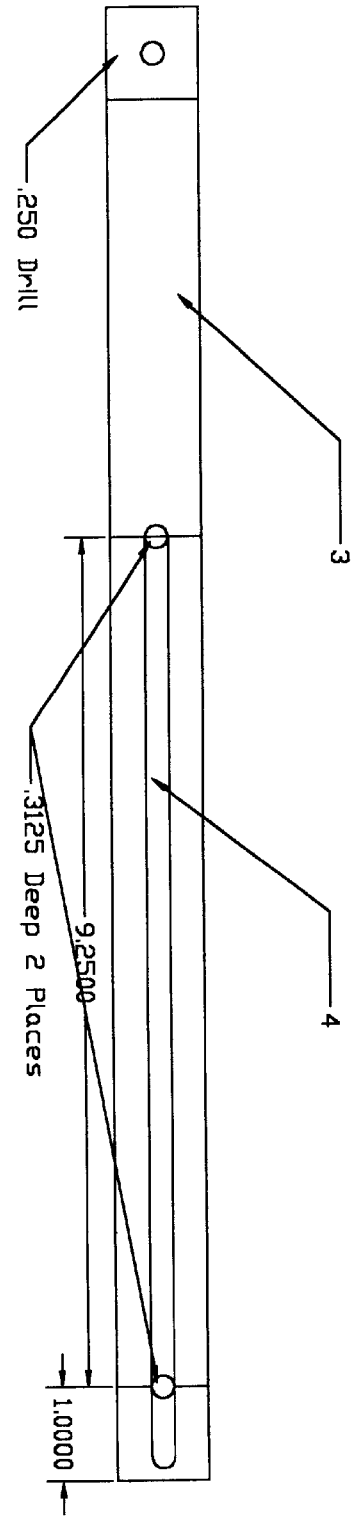
FIG. 2 shows the extendable handle, slide shaft, top view.
Figure 2A:
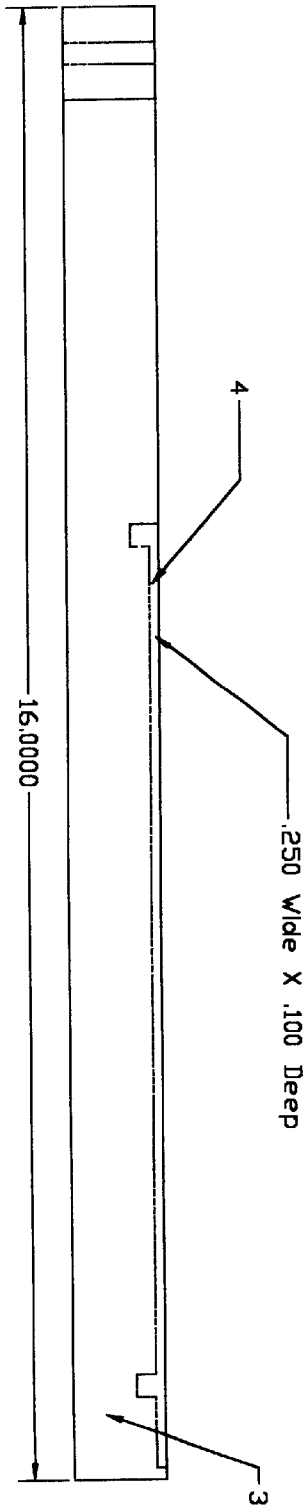
FIG. 2A shows the extendable handle, slide shaft, side view.
Figure 3:
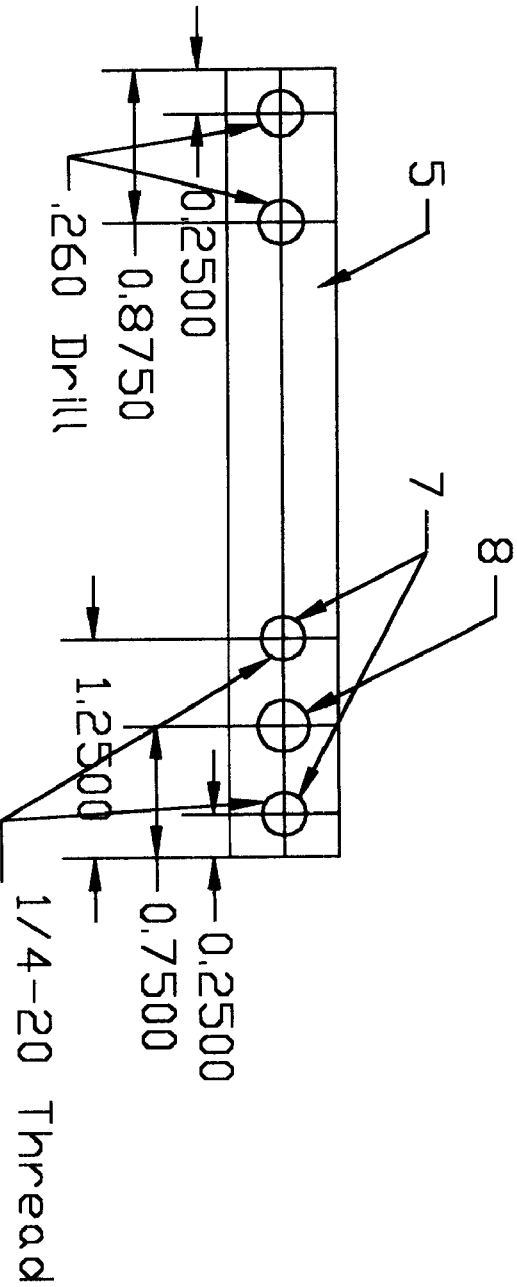
FIG. 3 depicts a top view of the spring plate of the locking mechanism.
Figure 3A:
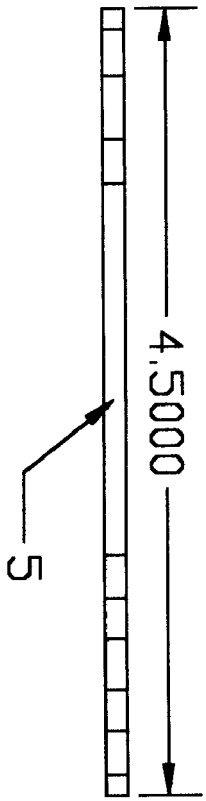
FIG. 3A depicts a side view of the spring plate of the locking mechanism.
Figure 4:
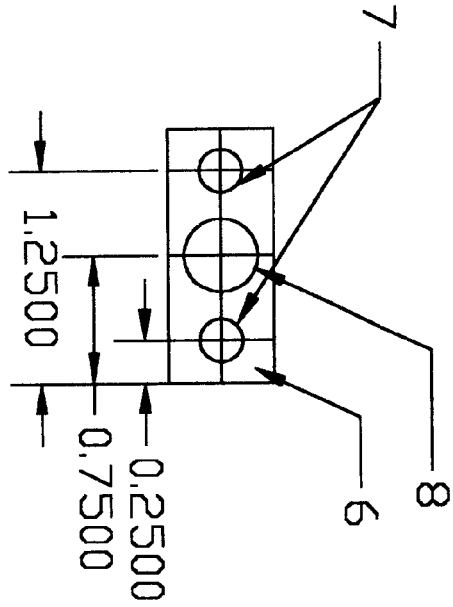
FIG. 4 depicts a top view of the spring cap of the locking mechanism.
Figure 4A:
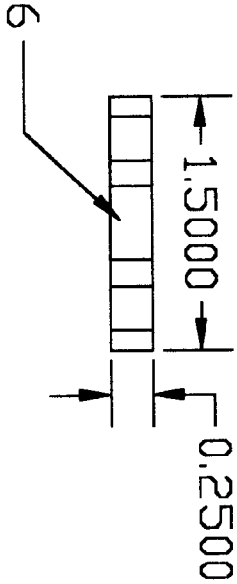
FIG. 4A depicts a side view of the spring cap of the locking mechanism.

A preferred embodiment of the lightweight extendable handle for demolition tools of the present invention is illustrated in FIG. 1, gripping handle (top view), FIG. 1A (side view); FIG. 2, slide shaft (top view), FIG. 2A (side view); FIG. 3, spring plate; and FIG. 4, hinge cap. The extendable tool handle has a gripping handle (1) 16.00 inches in length, constructed of 2024 T3 aluminum tubing with 1.00 inch internal diameter. The gripping handle (1) has a 13 inch knurled segment (2) (16 turns per inch) on the bottom segment. A 19/64 inch locking aperture hole is drilled through the gripping handle (1).

A slide shaft (3) of 6AL 4V titanium, 1 inch external diameter, 16.50 inches in length is finished to smoothly slide within the gripping handle (1). One longitudinal slide groove (4) 10.25 inches by 19/64 inches is machined into the slide shaft (3) to a first radial depth. A 19/64 hole is drilled to a radial depth greater than the slide groove (4) to provide a recess for the 19/64 button head screw (8) that functions to lock the slide shaft (3) in either the extended or contracted position by extending through the corresponding locking aperture in the outer gripping handle (1).

The locking mechanism consists of a segment of 2024 T3 aluminum band material ¼ inch by 1.00 inch, by 4.50 inches long which functions as a spring plate (5) by means of being affixed at the bottom end to the gripping handle (1) by means of two ¼ by 20 button head screws (7) for which the gripping handle (1) has been tapped. A spring cap (6) of the same 2024 T3 aluminum material is affixed to the spring plate (5) on the free end by means of two ¼ by 20 button head screws for which it has be tapped. The spring cap (6) provides a mount for the 19/64 button head screw (8) which serves as a lock pin through which the slide groove (4) travels, and a mount for the pull wire (9), a loop of stainless steel wire, which facilitates flexing the spring plate (5) to release the slide shaft (3). The spring cap (6) in machined horizontally on the lower surface to provide a means of affixing the pull wire (9) by means of pinching it between the spring plate (5) and the spring cap (6).

A mounting hole (10) is drilled through the top end of the slide shaft (3) to facilitate affixing various tool heads.

Advantages

From the description above, a number of advantages of the lightweight extendable handle for demolition tools become evident:

(a) The extendable handle provides a sturdy handle of durable materials that will not crack or bend even in the most severe application.

(b) The extendable handle, though extremely durable, is also very light in weight, and will not contribute to operator fatigue during carrying or operation.

(c) The extendable handle reduces bulk during transportation and eliminates a long handle that is cumbersome.

Operation—FIGS. 1, 1A, 2, 2A

The manner of using the lightweight extendable handle for demolition tools is to first affix it to a tool head by means of bolting or pinning as the tool head requires. The handle may then be extended by momentarily pulling on the pull wire (9). This releases the slide shaft (3) to move freely by means of the shaft groove (4) until the handle is fully extended and locked in place as the spring plate forces the 19/64 button head screw (8) in the drilled detente hole at the end of the slide groove (4). The tool may then be used with the handle fully extended. The tool handle can be collapsed by reversing this procedure. Of course, in confined spaces the tool may be operated with the handle fully collapsed.

Conclusion, Ramification, and Scope

Accordingly the reader will see that the lightweight extendable handle for demolition tools of this invention can be used to provide a universal tool handle that can be used with many tool head applications. Furthermore, the extendable tool handle has additional advantages in that:

It provides a demolition tool handle that is very strong and will not fracture, bend or fail, even under the most severe use.

It provides a handle that is very light in weight and will not contribute to operator fatigue, either while being carried or used.

It provides a tool handle that can reduce the overall length of the tool by as much as 50% during the transport or carrying portion of tool operation, and in so doing reduce bulk and increase carrying convenience.

Although the description above contains many specificities, these should not be construed as limiting the scope of the invention, but merely as a means to provide an illustration of the presently preferred embodiments of this invention.

Thus the scope of the invention should be determined by the appended claims, and their legal equivalents, rather than the illustrations herein given.

I claim:

1. A handle for demolition tools, comprising:

an outer tube having a hollow section and a locking aperture;

an extendable inner portion coupled to said outer tube so as to be slidably moveable within said hollow section between a collapsed position and an extended position;

said inner portion having a longitudinal groove therein and first and second recesses, said longitudinal groove having a first radial depth, said first and second recesses spaced from one another along said groove and having a radial depth greater than said groove;

a locking mechanism operative to releaseably lock said inner portion in said collapsed position and in said extended position; said locking mechanism comprising:

an elongate spring plate having first and second end portions, said first end portion affixed to an outer surface of said outer tube so as to not move relative thereto, said second end portion moveable inward and outward relative to said outer surface to lock and release said inner portion respectively;

a locking pin coupled to said second end of said spring plate so as to move therewith;

wherein said locking pin extends through said locking aperture and engages said first recess in said collapsed position and extends through said locking aperture and engages said second recess in said extended position; and wherein said second end of said spring plate must be moved outward relative to said outer tube so as to disengage said locking pin from said first or second recess in order to release said inner tube for movement between said collapsed position and said extended position.

2. The handle of claim 1 wherein said locking mechanism is spaced from an end of said outer tube through which said inner portion extends by at least three inches.

3. The handle of claim 1 wherein said locking mechanism further comprises a pull wire coupled to said second end of said spring plate.

4. The handle of claim 1 wherein said hollow section has an diameter of at least one inch.

5. The handle of claim 1 wherein said inner portion has an end disposed distally from said outer tube in said extended position, said end having a hole adapted to accept a demolition tool head.

6. The handle of claim 1 wherein said outer tube comprises aluminum and wherein said inner portion comprises titanium.

7. The handle of claim 1 further comprising knurling on said outer portion of said outer tube.

8. The handle of claim 1 wherein:

said locking mechanism is spaced from an end of said outer tube through which said inner portion extends by at least three inches;

said locking mechanism further comprises a pull wire coupled to said second end of said spring plate; and said hollow section has an diameter of at least one inch.

* * * * *